US006161263A

United States Patent [19]

Anderson

[11] Patent Number: 6,161,263

[45] Date of Patent: Dec. 19, 2000

[54] SOCK PAIR RETENTION APPARATUS

[76] Inventor: Paul Anderson, Salisbury House-Barkshire Drive, Thatcham Barkshire, United Kingdom, RG194ER

[21] Appl. No.: 09/103,987

[22] Filed: Jun. 24, 1998

Related U.S. Application Data

[60] Provisional application No. 60/050,708, Jun. 25, 1997.

[51] Int. Cl.[7] ..... A41F 1/00

[52] U.S. Cl. ..... 24/545; 24/DIG. 29; 24/563; 24/30.5 S

[58] Field of Search ..... 29/30.5 R, 30.5 S, 29/563, 30.5 P, 30.5 L, 561, 545, DIG. 29; 383/25, 293, 71; 2/239

[56] References Cited

U.S. PATENT DOCUMENTS

| | | |
|---|---|---|
| D. 187,636 | 4/1960 | Nagel . |
| D. 231,310 | 4/1974 | Burgher . |
| D. 319,903 | 9/1991 | Barner . |
| 3,170,231 | 2/1965 | Thomas, Sr. . |
| 3,357,070 | 12/1967 | Sloan . |
| 3,365,761 | 1/1968 | Kalvig . |
| 3,603,551 | 9/1971 | Peterson . |
| 3,820,200 | 6/1974 | Myers . |
| 3,962,757 | 6/1976 | Gedney . |
| 4,189,808 | 2/1980 | Brown . |
| 4,267,995 | 5/1981 | McMillan . |
| 4,631,783 | 12/1986 | Hayashi . |
| 4,644,610 | 2/1987 | Fish . |
| 4,697,312 | 10/1987 | Freyer . |
| 4,914,789 | 4/1990 | Pederson . |
| 5,381,588 | 1/1995 | Nelson . |
| 5,695,088 | 12/1997 | Kasbohm . |

*Primary Examiner*—James R. Brittain

[57] ABSTRACT

A sock pair retention apparatus includes a resilient membrane which includes a plurality of resilient flap members formed within the membrane. The resilient flap members are oriented in a common plane when in a relaxed mode and are deformed out of the plane when in a sock-retention mode. When one or more socks is pushed between the resilient flap members, the resilient flap members are pushed out of the plane and are in a sock-retention mode. The resiliency of the resilient flap members serves to lock the socks in the sock pair retention apparatus of the invention. The socks can be removed from the sock pair retention apparatus by simply pulling the socks completely through the membrane. The sock pair retention apparatus enables pairs of socks to remain together through washing and drying. When the socks are removed from the membrane, the resilient flap members can return to their relaxed mode. A frame member can be connected to a periphery of the membrane. The frame member defines a frame-enclosed region. The frame member has a frame height, and the resilient flap members have a flap thickness. The frame height is greater than the flap thickness. With another embodiment of the invention, additional frame portions provide a second frame-enclosed region, whereby one sock can be retained in each frame-enclosed region.

1 Claim, 3 Drawing Sheets

FIG 5
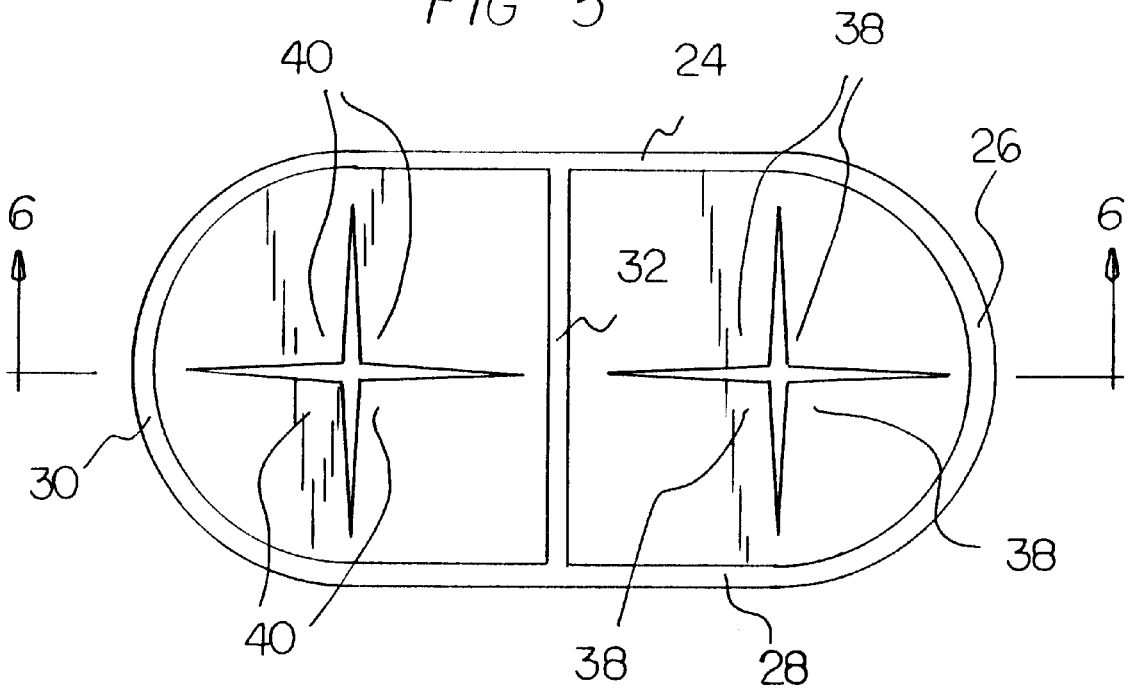
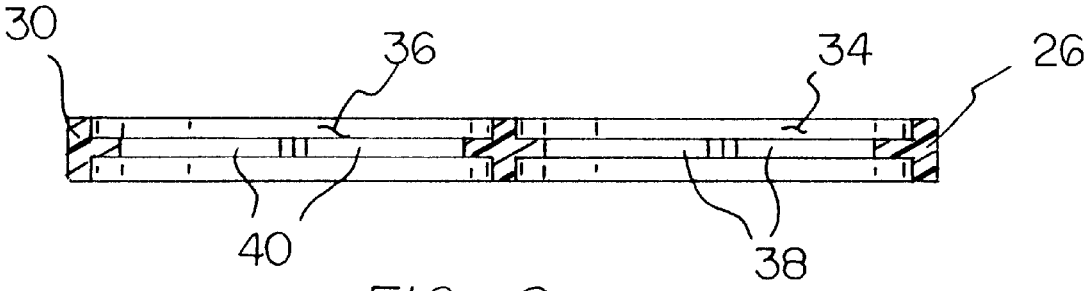
FIG 6

SOCK PAIR RETENTION APPARATUS

CROSS-REFERENCE TO RELATED APPLICATION

This application claims priority based upon my prior copending provisional application Ser. No. 60/050,708, filed Jun. 25, 1997.

BACKGROUND OF THE INVENTION

1. Field of the Invention

The present invention relates generally to clothing holders and, more particularly, to a clothing holder especially adapted for retaining socks in pairs when the socks are sent through laundry operations such as washing and drying.

2. Description of the Prior Art

Socks are purchased and used in matched pairs. However, during laundry operations pairs of socks are separated. It is often a difficult and time-consuming task to sort and organize a number of laundered socks into matched pairs again. In this respect, throughout the years, a number of innovations have been developed relating to retaining socks in matched pairs during laundry operations, and the following U.S. patents are representative of some of those innovations: U.S. Pat. No. Des. 231,310, U.S. Pat. No. Des. 319,903, and U.S. Pat. No. 5,381,588. More specifically, U.S. Pat. No. Des. 231,310 discloses a ring for holding a pair of socks. It is noted that this ring has a constant thickness throughout its full extent. As a result, the sock holding flaps and the peripheral support have the same thickness. Consequently, if the ring is relatively thin, the sock holding flaps may be easy to bend, but the structural strength provided by the peripheral support may be weak. Conversely, if the ring is relatively thick, the peripheral support may be adequate, but the sock holding flaps may be relatively stiff so as to damage the socks in use. In this respect, it would be desirable if a sock pair retention device were provided which has relatively thin sock holding flaps and relatively thick peripheral support.

U.S. Pat. No. 319,903 discloses a stocking holder which has a tag-like portion that extends outward from a peripheral ring support for inner stocking holding flaps. Such tag-like extensions require the use of relatively large amounts of material. Moreover, such tag-like extensions have relatively sharp corners which may dig into and damage stockings. In this respect, it would be desirable if a sock pair retention device were provided which does not have sharp external corners.

U.S. Pat. No. 5,381,588 discloses another sock holding device which employs a common thickness for both the sock holding flaps and the peripheral support.

In addition, the following U.S. patents disclose some additional innovations in which a membrane has internal flaps and a peripheral support portion: U.S. Pat. Nos. 3,357,070, 3,820,200, and 4,914,789. More specifically, U.S. Pat. No. 3,357,070 discloses another garment holding device that employs a common thickness for both the garment holding flaps and the peripheral support. U.S. Pat. No. 3,820,200 discloses a bag closure in which both bag-holding flaps and a peripheral support have a common thickness.

U.S. Pat. No. 4,914,789 discloses a closure clip for flexible bags. This device employs relatively thin inner flaps and a relatively thick peripheral support. It is noted however, that the inner flaps have internal apertures with right-angled corners. Such internal, right-angled apertures may provide locations for socks to tie up and twist. To avoid such tying and twisting, it would be desirable if a sock pair retention device were provided which does not include internal, right-angled apertures.

Still other features would be desirable in a sock pair retention apparatus. For example, instead of placing two socks of pair through a single set of internal flaps, it may be desirable, especially in the case of very thick socks, to place only one sock through a set of retention flaps. In this respect, it would be desirable if a sock pair retention device were provided which has two sets of sock retention flaps, one set for each sock in a pair of socks.

Thus, while the foregoing body of prior art indicates it to be well known to use sock pair retention devices, the prior art described above does not teach or suggest a sock pair retention apparatus which has the following combination of desirable features: (1) has relatively thin sock holding flaps and relatively thick peripheral support; (2) does not have sharp external corners; (3) does not include internal, right-angled apertures; and (4) can have two sets of sock retention flaps, one set for each sock in a pair of socks. The foregoing desired characteristics are provided by the unique sock pair retention apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a sock pair retention apparatus which includes a resilient membrane which includes a plurality of resilient flap members formed within the membrane. The resilient flap members are oriented in a common plane when in a relaxed mode, and the resilient flap members are deformed out of the plane when in a sock-retention mode. When one or more socks is pushed between the resilient flap members, the resilient flap members are pushed out of the plane and are in a sock-retention mode. The resiliency of the resilient flap members serves to lock the socks in the sock pair retention apparatus of the invention. The socks can be removed from the sock pair retention apparatus by simply pulling the socks completely through the membrane. The sock pair retention apparatus enables pairs of socks to remain together through washing and drying. When the socks are removed from the membrane, the resilient flap members can return to their relaxed mode.

A frame member can be connected to a periphery of the membrane. The frame member defines a frame-enclosed region. The frame member can be circular and can define a circular frame-enclosed region. There are four resilient flap members, and each of the resilient flap members occupies substantially a quadrant in the circular frame-enclosed region. The frame member has a frame height, and the resilient flap members have a flap thickness. The frame height is greater than the flap thickness.

With another embodiment of the invention, the frame member includes a straight first frame portion. A semi-circular second frame portion is connected to the first frame portion. A straight third frame portion is connected to the second frame portion. A semi-circular fourth frame portion is connected between the third frame portion and the first frame portion. A straight fifth frame portion is connected between the first frame portion and the third frame portion. The fifth frame portion bisects the first frame portion and the third frame portion. Half of the first frame portion, the entire second frame portion, half of the third frame portion, and the entire fifth frame portion define a first frame section which defines a first frame-enclosed region. Half of the third frame portion, the entire fourth frame portion, half of the first frame portion, and the entire fifth frame portion define a second frame section which defines a second frame-enclosed region.

The resilient flap members includes a set of four first flap members which extend into the first frame-enclosed region from the first frame section. A set of four second flap members extend into the second frame-enclosed region from the second frame section.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sock pair retention apparatus which has all of the advantages of the prior art and none of the disadvantages.

It is another object of the present invention to provide a new and improved sock pair retention apparatus which may be easily and efficiently manufactured and marketed.

It is a further object of the present invention to provide a new and improved sock pair retention apparatus which is of durable and reliable construction.

An even further object of the present invention is to provide a new and improved sock pair retention apparatus which is susceptible of a low cost of manufacture with regard to both materials and labor, and which accordingly is then susceptible of low prices of sale to the consuming public, thereby making such sock pair retention apparatus available to the buying public.

Still yet a further object of the present invention is to provide a new and improved sock pair retention apparatus which has relatively thin sock holding flaps and relatively thick peripheral support.

Still another object of the present invention is to provide a new and improved sock pair retention apparatus that does not have sharp external corners.

Yet another object of the present invention is to provide a new and improved sock pair retention apparatus which does not include internal, right-angled apertures.

Even another object of the present invention is to provide a new and improved sock pair retention apparatus that can have two sets of sock retention flaps, one set for each sock in a pair of socks.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a top view of a second embodiment of the sock pair retention apparatus of the invention.

FIG. 6 is a cross-sectional view of the embodiment of the invention shown in FIG. 5 taken along line 6—6 thereof.

DESCRIPTION OF THE PREFERRED EMBODIMENT

With reference to the drawings, a new and improved sock pair retention apparatus embodying the principles and concepts of the present invention will be described.

Figure 1:
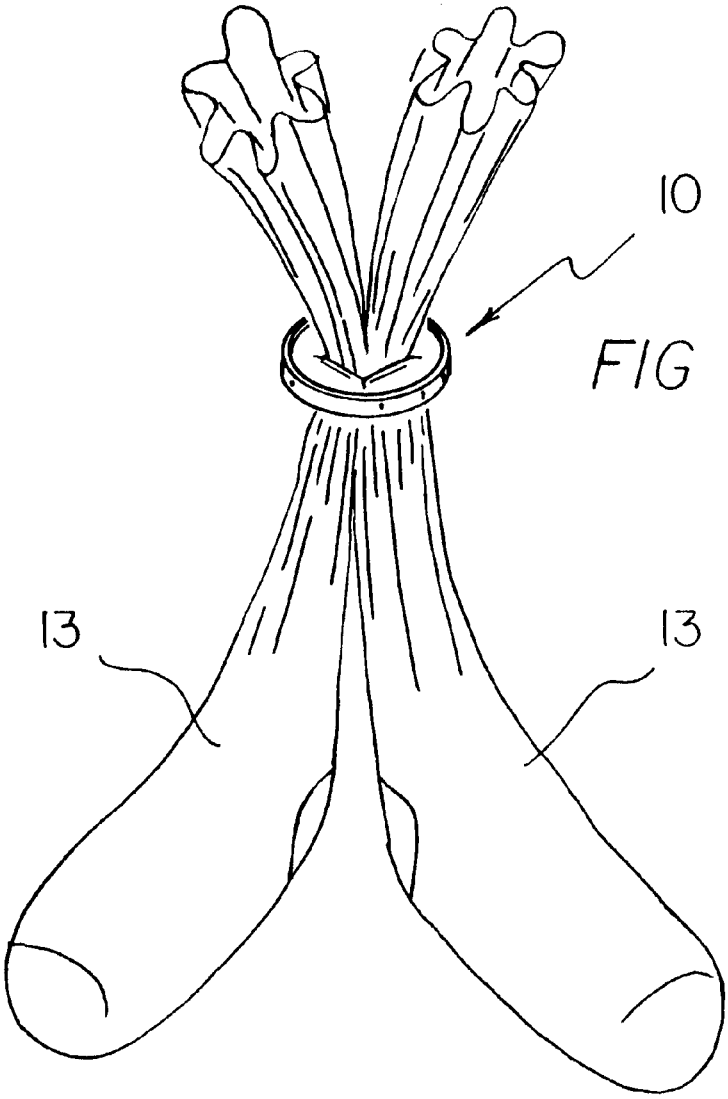
FIG. 1 is a perspective view showing a first embodiment of the sock pair retention apparatus of the invention in use retaining a pair of socks.
Figure 2:
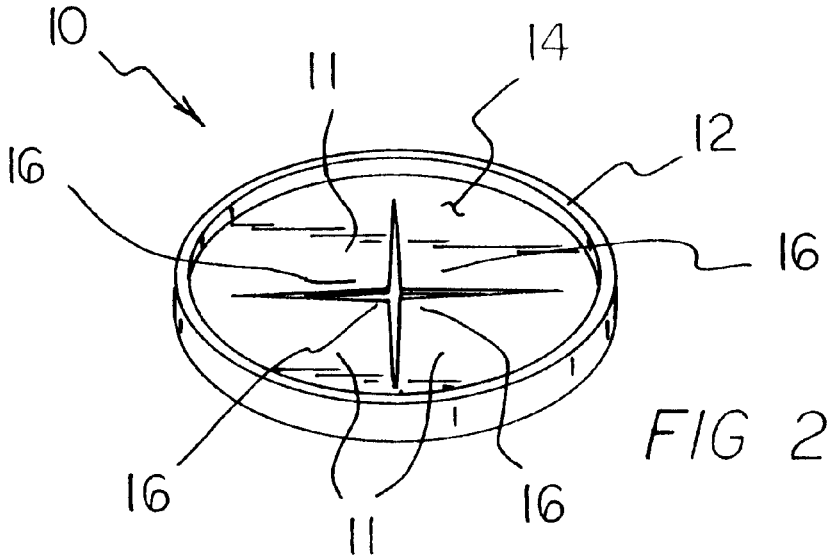
FIG. 2 is an enlarged perspective view of the embodiment of the invention shown in FIG. 1 with the pair of socks removed.
Figure 3:
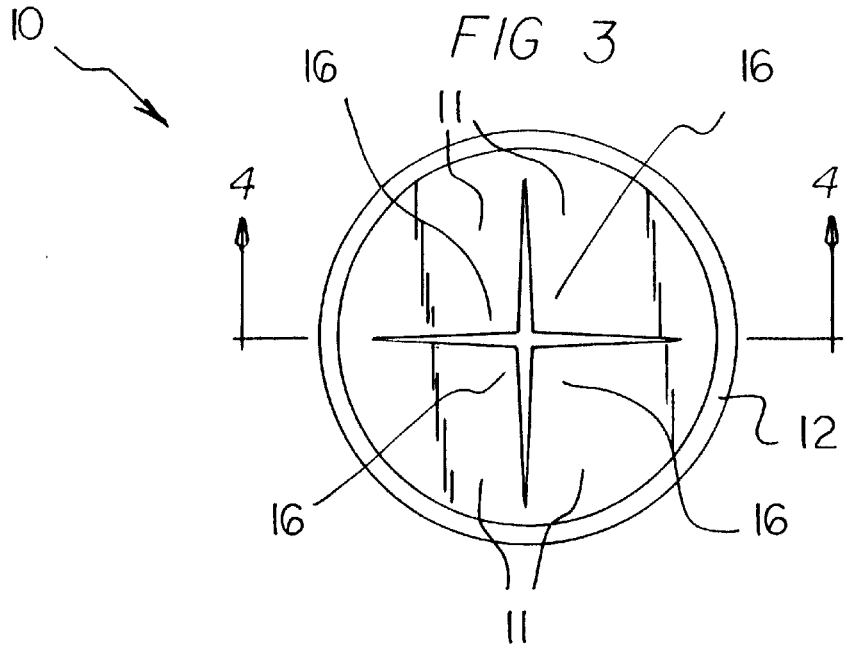
FIG. 3 is a top view of the embodiment of the invention shown in FIG. 2.
Figure 4:
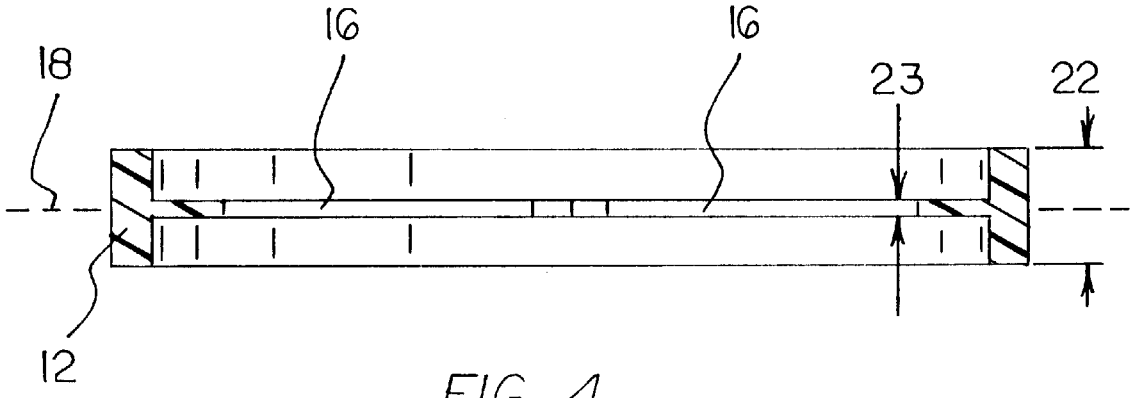
FIG. 4 is an enlarged cross-sectional view of the embodiment of the invention shown in FIG. 3 taken along line 4—4 thereof.

Turning to FIGS. 1–4, there is shown a first embodiment of the sock pair retention apparatus of the invention generally designated by reference numeral 10. More specifically, a sock pair retention apparatus 10 includes a resilient membrane 11 which includes a plurality of resilient flap members 16 formed within the membrane 11. The resilient flap members 16 are oriented in a common plane 18 when in a relaxed mode, and the resilient flap members 16 are deformed out of the plane 18 when in a sock-retention mode. When one or more socks 13 is pushed between the resilient flap members 16, the resilient flap members 16 are pushed out of the plane 18 and are in a sock-retention mode. The resiliency of the resilient flap members 16 serves to lock the socks in the sock pair retention apparatus 10 of the invention. The socks can be removed from the sock pair retention apparatus 10 by simply pulling the socks completely through the membrane 11. The sock pair retention apparatus 10 enables pairs of socks to remain together through washing and drying. When the socks are removed from the membrane 11, the resilient flap members 16 can return to their relaxed mode.

A frame member 12 can be connected to a periphery of the membrane 11. The frame member 12 defines a frame-enclosed region 14. The frame member 12 can be circular and can define a circular frame-enclosed region 14. There are four resilient flap members 16, and each of the resilient flap members 16 occupies substantially a quadrant in the circular frame-enclosed region 14. The frame member 12 has a frame height 22, and the resilient flap members 16 have a flap thickness 23. The frame height 22 is greater than the flap thickness 23.

A specific embodiment of the invention can have a circular frame member 12 that is 50 mm in diameter. The frame height 22 can be 3 mm. The flap thickness 23 can be 1 mm. Moreover, the material composing the sock pair retention apparatus 10 of the invention can be a plastic or rubber composition that is selected so that the material withstands the temperatures of washing and drying. If desired, the sock pair retention apparatus 10 of the invention can be color coded. Each family member can be assigned a particular color of the sock pair retention apparatus 10.

Turning to FIGS. 5 and 6, a second embodiment of the invention is shown. Reference numerals are shown that correspond to like reference numerals that designate like elements shown in the other figures. In addition, the frame member 12 includes a straight first frame portion 24. A semi-circular second frame portion 26 is connected to the first frame portion 24. A straight third frame portion 28 is connected to the second frame portion 26. A semi-circular fourth frame portion 30 is connected between the third frame portion 28 and the first frame portion 24. A straight fifth frame portion 32 is connected between the first frame portion 24 and the third frame portion 28. The fifth frame portion 32 bisects the first frame portion 24 and the third frame portion 28. Half of the first frame portion 24, the entire second frame portion 26, half of the third frame portion 28, and the entire fifth frame portion 32 define a first frame section which defines a first frame-enclosed region 34. Half of the third frame portion 28, the entire fourth frame portion 30, half of the first frame portion 24, and the entire fifth frame portion 32 define a second frame section which defines a second frame-enclosed region 36.

The resilient flap members 16 include a set of four first flap members 38 which extend into the first frame-enclosed region 34 from the first frame section. A set of four second flap members 40 extend into the second frame-enclosed region 36 from the second frame section.

The second embodiment of the invention is used in substantially the same way of the first embodiment of the invention described above. If desired, a first pair of socks can be retained by the first flap members 38, and a second pair of socks can be retained by the second flap members 40. Alternatively, only one sock of a pair can be retained by the first flap members 38, and one sock of the pair can be retained by the second flap members 40.

To make the first embodiment of the invention, a piece of plastic can be injection molded into the form of a membrane enclosed by a frame. Then, cross cuts can be made in the membrane. To make an embodiment of the invention which does not include a frame member 12, a single sheet of material comprising the membrane 11 is formed and cross cut, leaving a peripheral border region which is not cut. The ends of the cross cuts can include circularly shaped ends. Such circularly shaped ends of the cross cuts prevent the cross cuts from extending into the peripheral border region.

The components of the sock pair retention apparatus of the invention can be made from inexpensive plastic and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sock pair retention apparatus that is low in cost, relatively simple in design and operation, and which may advantageously be used having relatively thin sock holding flaps and relatively thick peripheral support. With the invention, a sock pair retention apparatus is provided which does not have sharp external corners. With the invention, a sock pair retention apparatus is provided which does not include internal, right-angled apertures. With the invention, a sock pair retention apparatus is provided which can have two sets of sock retention flaps, one set for each sock in a pair of socks.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A sock pair retention apparatus, comprising:

a resilient membrane which includes a plurality of resilient flap members formed within said membrane, wherein said resilient flap members are oriented in a common plane when in a relaxed mode, and wherein said resilient flap members are deformed out of said plane when in a sock-retention mode, and a frame member connected to a periphery of said membrane, wherein said frame member defines a frame-enclosed region, wherein said frame member has a frame height, wherein said resilient flap members have a flap thickness, and wherein said frame height is greater than said flap thickness, wherein said frame member includes a straight first frame portion, a semi-circular second frame portion connected to said first frame portion, a straight third frame portion connected to said second frame portion, a semi-circular fourth frame portion connected between said third frame portion and said first frame portion, and a straight fifth frame portion connected between said first frame portion and said third frame portion, wherein said fifth frame portion bisects said first frame portion and said third frame portion;

wherein half of said first frame portion, said second frame portion, half of said third frame portion, and said fifth frame portion define a first frame section which defines a first frame-enclosed region, and half of said third frame portion, said fourth frame portion, half of said first frame portion, and said fifth frame portion define a second frame section which defines a second frame-enclosed region; and wherein said resilient flap members include:

a set of four first flap members which extend into said first frame-enclosed region from said first frame section, and a set of four second flap members which extend into said second frame-enclosed region from said second frame section, each of said flap members being characterized by a pair of slots in said membrane extending from the center of a corresponding frame-enclosed region toward said frame member and terminating a predetermined distance spaced inwardly from said frame member with respect to said center of each said corresponding frame-enclosed region, and wherein each of said slots is characterized by a substantially triangular shape when projected onto said common plane;

wherein the slots in each said pair of slots mutually intersect one another and are orthogonally oriented with respect to each other to define a passageway in the region of mutual intersection thereof when said flexible flaps are deformed out of said common plane, and wherein a pair of socks extends through each said passageway defined by each said pair of slots, respectively. each sock in said pair being engaged by said deformed flexible flaps, respectively, such that said pair of socks is retained by said frame member and both said frame member and said pair of socks retained thereby may be maintained together during a laundry operation.

* * * * *